US005949181A

United States Patent [19]

Tabata et al.

[11] Patent Number: 5,949,181

[45] Date of Patent: Sep. 7, 1999

[54] AUTOMOTIVE LAMP BULB WITH ALIGNMENT BEAD

[75] Inventors: Hajime Tabata; Toru Hasegawa, both of Saitama, Japan

[73] Assignee: Honda Giken Kogyo Kabushiki Kaisha, Tokyo, Japan

[21] Appl. No.: 08/868,660

[22] Filed: Jun. 4, 1997

[30] Foreign Application Priority Data

Jun. 4, 1996 [JP] Japan ..... 8-141886

[51] Int. Cl.[6] ..... H01K 1/18

[52] U.S. Cl. ..... 313/271; 313/272; 313/315; 313/578; 313/579

[58] Field of Search ..... 313/579, 578, 313/271, 272, 273, 275, 285, 42, 315, 316, 277

[56] References Cited

U.S. PATENT DOCUMENTS

| | | | |
|---|---|---|---|
| 3,497,753 | 2/1970 | Huston, Jr. | 313/275 |
| 3,872,560 | 3/1975 | Bock | 445/44 |
| 4,801,845 | 1/1989 | Kiesel | 313/271 |
| 5,270,609 | 12/1993 | Smith et al. | 313/271 |

FOREIGN PATENT DOCUMENTS

| | | | |
|---|---|---|---|
| 3-064853 | 3/1991 | Japan | H01K 3/22 |
| 4-81349 | 7/1992 | Japan | H01K 1/18 |
| 4081349 | 7/1992 | Japan | H01K 1/18 |

*Primary Examiner*—Michael Day
*Attorney, Agent, or Firm*—Birch Stewart Kolasch & Birch, LLP

[57] ABSTRACT

An automotive lamp bulb is provided that is easy to assemble. A glass bulb has a tip with a short projection at its upper end. A common lead wire is secured in a neck portion of the glass bulb with the aid of a bead. The bead makes it possible to shorten the upper end of the glass bulb. The use of the bead also makes it easier to align the common lead wire with the neck portion. Because the bead is interposed therebetween, the common lead wire is allowed to slide in relation to the glass bulb, thus making it possible to use inexpensive hard glass. Consequently, an inexpensive and compact automotive lamp bulb can be easily manufactured.

15 Claims, 4 Drawing Sheets

AUTOMOTIVE LAMP BULB WITH ALIGNMENT BEAD

BACKGROUND OF THE INVENTION

1. Field of the Invention

The present invention relates to an improvement in an automotive lamp bulb.

2. Description of Background Art

Japanese Laid-Open Utility Model Application Serial No. 4-81349 entitled "Halogen Lamp Bulb" describes an example of a technique related to automotive lamp bulbs.

FIGS. 6*a* and 6*b* are diagrams of a background art process for manufacturing a conventional halogen lamp bulb. FIG. 6*a* corresponds to FIG. 5 in the aforementioned application, while FIG. 6*b* corresponds to FIG. 6, but different symbols are used.

In FIG. 6*a*, a support wire 102 equipped with a glass tube 101 is inserted into a sealed glass body 103, the air is exhausted, and the assembly is heated. In the process, the exhausted gas or a halogen gas passes through a cylindrical conduit 104.

FIG. 6*b* is a diagram of the completed assembly and depicts a state in which the tip has been sealed by being softened and closed up with the aid of two burners (shown in FIG. 6*a*).

In the background art device of FIG. 6*a*, the passage resistance of the cylindrical conduit 104 is considerable because the glass tube 101 is long. The reason is that the passage resistance is directly proportional to the length and inversely proportional to the square of the cross-sectional surface area of the passage.

In view of this proportionality, the clearance must be enlarged in order to lower the resistance. An enlarged clearance increases the diameter of the sealed glass body 103. Considerable time is needed to reduce the large-diameter sealed glass body 103 to the shape shown in FIG. 6*b*.

To obtain a uniform clearance, it is necessary to align the center of the support wire 102 with the center of the sealed glass body 103, and an advanced technique is needed to achieve such centering.

Specifically, the background art technique involves complex processing steps and entails high processing costs.

Another feature of the problem is that, because of the considerable length of the glass tube 101 in FIG. 6*b*, a projection length HI of the sealed glass body 103 is inevitably increased, contributing to the bulkiness of the halogen lamp bulb.

SUMMARY OF THE INVENTION

A primary object of the present invention is to provide an automotive lamp bulb that is easy to manufacture and that has a short projection in its upper part.

Aimed at addressing the problems of the background art, the present invention pertains to an automotive lamp bulb wherein the opening of a glass bulb is sealed with the aid of a base, and at least one beam filament and at least two lead wires for supplying power to this beam filament are housed together inside the glass bulb. A distinctive feature is that one of the lead wires is extended, and the tip thereof is secured in the neck portion at the tip of the glass bulb with the aid of a bead.

The bead makes it possible to shorten the protruding upper portion of the glass bulb. Because the bead is merely in linear contact with the inner surface of the neck portion, a vent conduit can be formed, thus allowing exhausting and gas filling steps to be performed at a high rate. The use of the bead makes it easier to align the lead wire inside the neck portion. Because the bead is interposed, the lead wire is allowed to move in relation to the glass bulb, thus making it possible to use inexpensive hard glass.

Consequently, an inexpensive and compact lamp bulb can be easily manufactured.

Also, the invention is characterized by the fact that a protrusion for securing the bead is provided in the upper portion of the extended lead wire.

The bead can be positioned on the lead wire with high precision, thus making manufacturing easier.

Furthermore, the invention is characterized by the fact that vent conduits are formed in the bead.

Large vent conduits can be secured, thus making it possible to perform exhausting and gas filling steps in a short time.

Additionally, the invention is characterized by the fact that the vent conduits are either depressions formed on the outer periphery of the bead or clearances formed between flat surfaces of the bead and the inner surface of the neck portion.

Exhausting and gas filling steps can be accomplished in a short time because large vent conduits can be secured, and any cost increase can be prevented because the depressions or flat surfaces can be formed in a simple manner.

Moreover, in another embodiment, the invention is characterized by the fact that the vent conduits are clearances formed between an outer periphery of the lead wire and depressions formed on the inner periphery of the bead.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are shown for illustration only. Thus, they are not limitations on the present invention.

DETAILED DESCRIPTION OF THE PREFERRED EMBODIMENTS

Figure 1:
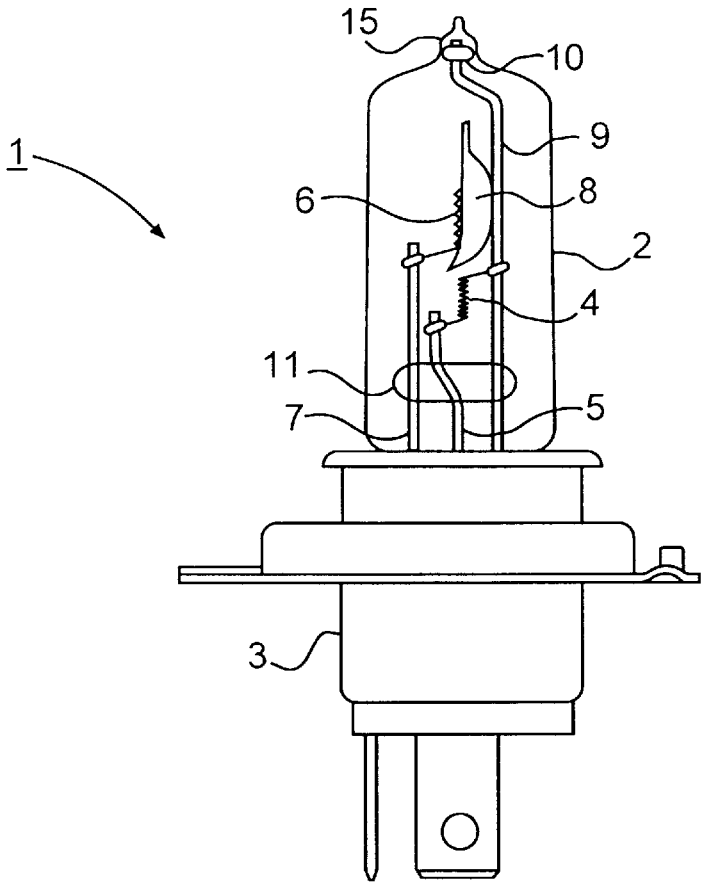
FIG. 1 is a diagram of the completed automotive lamp bulb pertaining to the present invention.

In FIG. 1, an automotive lamp bulb 1 is a special lamp bulb in which the opening of a glass bulb 2 is sealed at a bottom end with the aid of a base 3. Inside the glass bulb 2, a high-beam filament 4, a high-beam lead wire 5, a low-beam filament 6, a low-beam lead wire 7, a shield 8, and a common lead wire 9 are housed together. A halogen gas is sealed inside the glass tube 2.

A tip at an upper end of the common lead wire 9 is secured in the glass bulb 2 with the aid of a bead 10.

A bridge 11 is a glass member for securing together the lead wires 5, 7, and 9.

A suitable material for the glass bulb 2 and the bead 10 is the widely used glass called B203 containing borosilicate glass or hard glass.

When turned on, the high-beam filament 4 is illuminated via a circuit comprising, in the order indicated or in the reverse order, the lead wire 5, the high-beam filament 4, and the common lead wire 9.

When the low-beam filament 6 is turned on, it is illuminated via a circuit comprising, in the order indicated or in the reverse order, the lead wire 7, the low-beam filament 6, the shield 8, and the common lead wire 9. The main function of the shield 8 is to block part of the light emitted by the filament 6 so as to produce a low beam. Because the shield 8 is made of metal, it is connected to one end of the low-beam filament 6.

Figure 2:
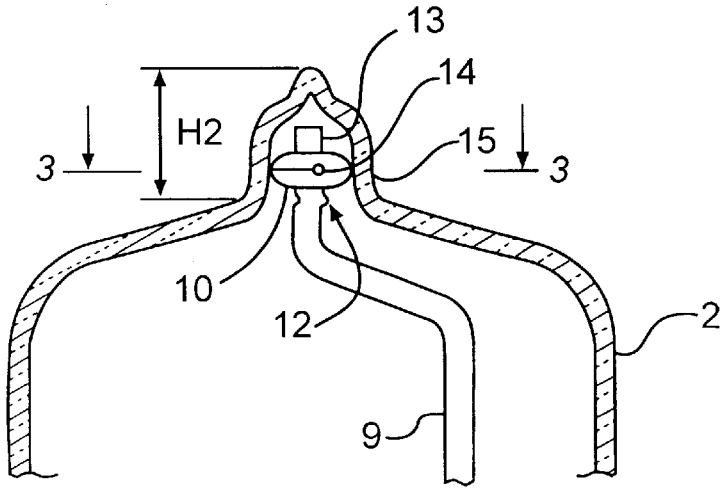
FIG. 2 is a diagram depicting the upper support structure of the automotive lamp bulb pertaining to the present invention.

FIG. 2 is a diagram depicting the upper support structure inside the glass bulb 2 of the automotive lamp bulb 1. The common lead wire 9 is a molybdenum rod. A securing protrusion 12 is formed in the upper portion of the lead wire 9, and a rectilinear portion 13 is left on top thereof. An outermost peripheral portion 14 of the bead 10 is pressed against an inner surface of a neck portion 15 of the glass bulb 2.

Because it is aligned horizontally, the outermost peripheral portion 14 of the bead 10 is pressed against the neck portion 15 of the glass bulb 2 while in linear contact therewith.

Because the bead 10 sits very low in the neck portion 15, the projection height H2 of the neck portion 15 is small.

Figure 3:
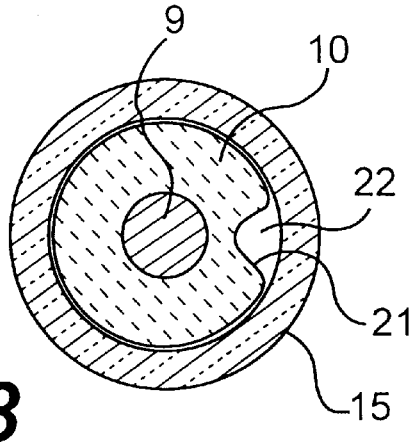
FIG. 3 is a cross section taken along line 3—3 of FIG. 2.

FIG. 3 depicts an example in which a vent depression 21 is formed on an outer periphery of the bead 10 surrounding the common lead wire 9. Thus, the clearance between the depression 21 and the neck portion 15 is used as a vent conduit 22.

The main points of the process for manufacturing the automotive lamp bulb presented above will now be described.

Figure 4A:
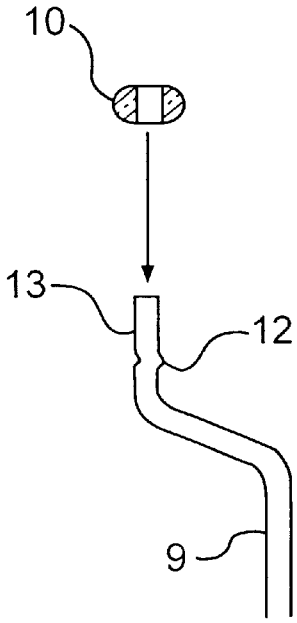
FIGS. 4*a* and 4*b* are diagrams illustrating two manufacturing steps for the automotive lamp bulb.
Figure 4B:
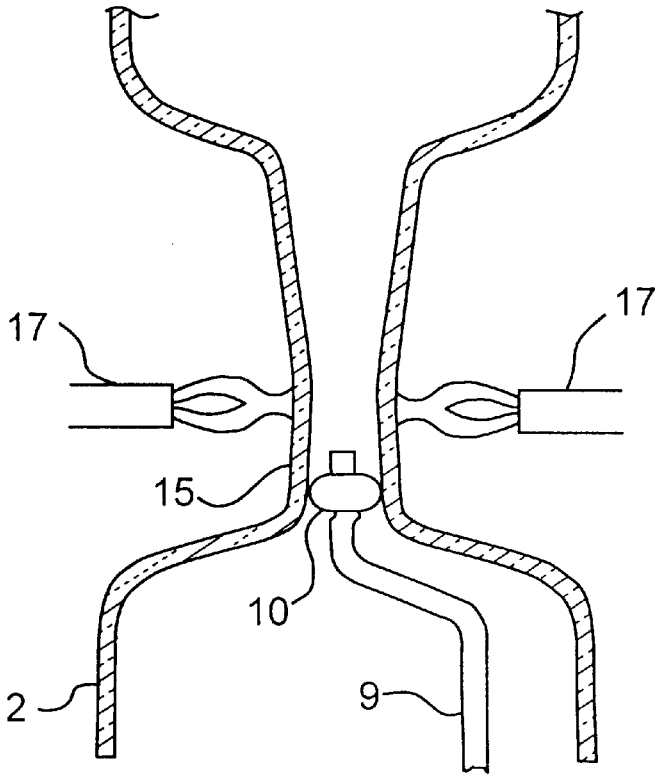

FIGS. 4*a* and 4*b* are diagrams illustrating the manufacture of the automotive lamp bulb.

In FIG. 4*a*, the bead 10 is attached to the upper portion of the common lead wire 9. Because the bead 10 is secured at the protrusion 12, the bead 10 is stably positioned below the rectilinear portion 13, and is thus easier to attach.

In FIG. 4*b*, the common lead wire 9 equipped with the bead 10 is inserted into the neck portion 15 of the glass bulb 2. The inside diameter of the neck portion 15 is slightly greater than the outside diameter of the bead 10.

The air is exhausted, nitrogen gas or another inert gas is introduced instead, and the neck portion 15 is heated with burners 17 in the atmosphere of the inert gas.

Halogen gas is then sealed inside in accordance with the gas sealing method described below.

(1) The base 3 of FIG. 1 is located at a distance from the neck portion 15 of the glass bulb 2 and is forcibly cooled with liquid nitrogen or another coolant.

(2) The interior of the glass bulb 2 is filled with a high-pressure halogen gas once the inert gas is thermally shrunk.

(3) The neck portion 15 is closed up and sealed, thus yielding the shape shown in FIG. 2.

In step (1) above, the common lead wire 9 is also cooled with the base 3. Because the common lead wire 9 is made of metal and has a higher thermal conductivity than glass, the neck portion 15 of the glass bulb 2 reaches a low softening temperature in a short time.

The neck portion 15 is partially cooled if the rectilinear portion 13 of the cooled lead wire 9 is in direct contact with the neck portion 15.

The glass bulb 2 does not pose any problems if it has a low coefficient of thermal expansion, can withstand thermal shocks, and is made of quartz glass.

However, cracks are likely to develop in the neck portion 15 if the glass bulb 2 is made of hard glass, which has a higher coefficient of thermal expansion than quartz glass.

In view of this difference, the temperature of the common lead wire 9 is reduced below that of the neck portion 15. Thus, hard glass can be used because the bead 10 with its low thermal conductivity is interposed between the upper rectilinear portion 13 of the common lead wire 9 and the neck portion 15 of the glass bulb 2, as shown in FIG. 4*b*.

Cases involving the use of hard glass and quartz glass are collected in Table 1 below.

As shown in FIG. 3, forming the vent depression 21 in the bead 10 and securing the vent conduit 22 allow the exhausted gas or halogen gas to escape primarily through the vent conduit 22, thus making it possible to accomplish exhausting and gas sealing steps with high efficiency.

It is also possible to use the bead 10 without the vent depression 21. In this case, as shown in FIG. 2, the clearance between the outermost peripheral portion 14 of the bead 10 and the inner peripheral surface of the neck portion 15 functions as a vent conduit. The reason is that, as described above, the bead 10 and the neck portion 15 are in linear contact with each other, with the result that the conduit is very short and the passage resistance low, thus ensuring a stable gas flow.

Figure 5A:
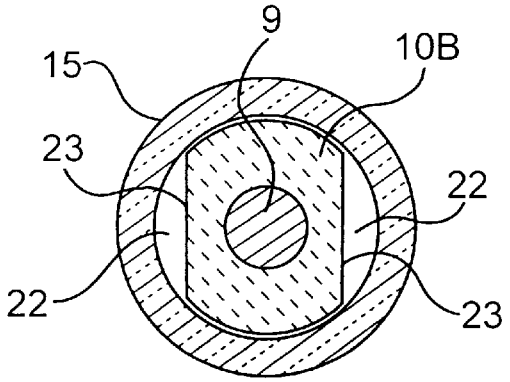
FIGS. 5*a* through 5*c* show three modified examples of the bead pertaining to the present invention.
Figure 5B:
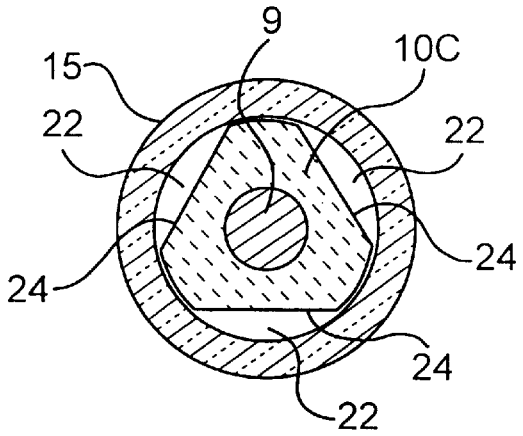
Figure 5C:
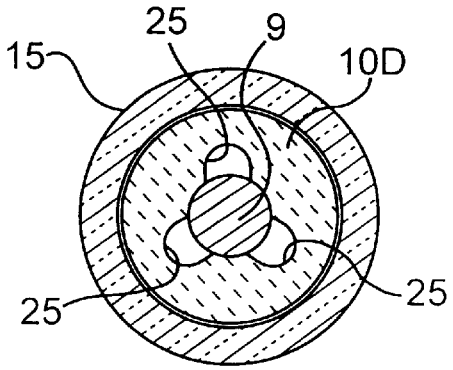
Figure 6A:
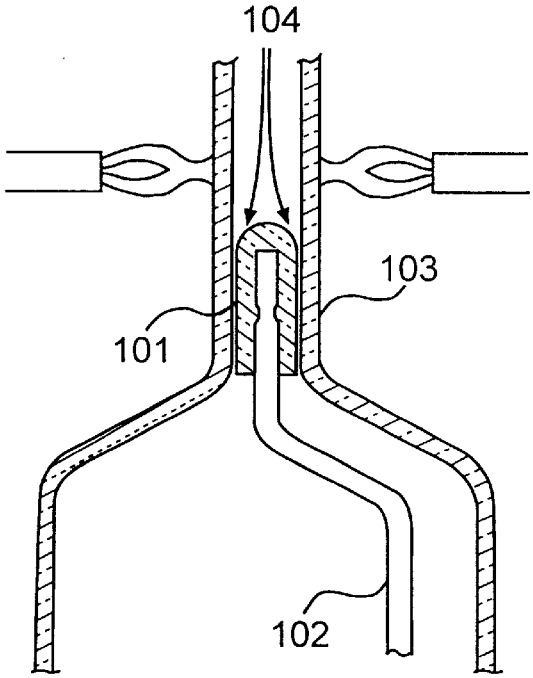
BACKGROUND ART FIG. 6a
FIGS. 6*a* and 6*b* are diagrams of the background art process for manufacturing a conventional halogen lamp bulb.
Figure 6B:
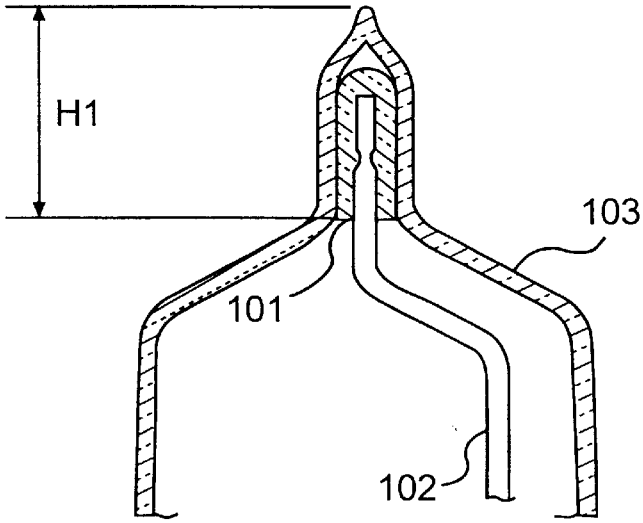
BACKGROUND ART FIG. 6b

FIGS. 5*a* through 5*c* are diagrams depicting modified examples of the bead 10 pertaining to the present invention.

In FIG. 5*a*, flat surfaces 23 are formed on an outer periphery of a bead 10B surrounding the common lead wire 9. Thus, thin half-moon clearances are formed between the flat surfaces 23 and a curved inner surface of the neck portion 15, and these clearances function as vent conduits 22. As used herein, the term "flat surface" refers to a flattened side surface obtained by cutting off a portion of a round bar of glass. The flat surface can also be formed by press molding the bead 10B.

In FIG. 5*b*, flat surfaces 24 are formed on an outer periphery of a bead 10C surrounding the common lead wire 9. Thin half-moon clearances are formed between the curved inner surface of the neck portion 15 and the flat surfaces 24, and these clearances also function as vent conduits 22.

In FIG. 5*c*, instead of being formed adjacent to the neck portion 15, a plurality of vent depressions 25 are formed adjacent to the common lead wire 9 on an inner periphery of a bead 10D.

Next, the "hard glass" adopted in the practical examples under consideration and the "quartz glass" adopted for some halogen lamp bulbs will be compared with reference to Table 1.

TABLE 1

| | | Practical Example | Comparative Example |
|---|---|---|---|
| Name | | Hard glass | Quartz glass |
| Reference components | $SiO_2$ | 56% | At least 96% |
| | $B_2O_3$ | 5% | At least 3.5% |
| | $Al_2O_3$ | 16% | At least 0.3% |
| | Other | 23% | Less than 0.2% |
| Softening point | | 926° C. | 1530° C. |
| Coefficient of thermal expansion | | | $7.5 \times 10^{-7}$/° C. |
| Cost | | Low | High |

Quartz glass, which is cited in the "Comparative Example" column, essentially consists of silica. It finds additional uses in high-grade test tubes and electric-heater coating glass because it is highly resistant to thermal shocks. As is shown in Table 1, this material has a high softening point (1530° C.), good heat resistance, and a low coefficient of thermal expansion. As a result, it develops high thermal strength. A drawback is its high cost.

Using this quartz glass makes it possible to bond the common lead wire 9 directly to the glass bulb 2. Thus, the glass bulb 2 does not break, even when the axial force generated by thermal expansion of the common lead wire 9 is exerted.

On the other hand, quartz glass has a high softening point, so the glass bulb 2 whose neck portion 15 is to be sealed must be heated to a high temperature.

Hard glass, which is cited in the "Practical Example" column, has low silica purity and is therefore inexpensive, but its softening point is only 926° C., so that its hot strength is considerably lower than that of quartz glass.

In view of this difference, the common lead wire 9 is secured in the glass bulb 2 with the aid of the bead 10, as shown in FIG. 2. It is expected that the bead 10 on the extended tip of the common lead wire 9 will slide in relation to the neck portion 15 of the glass bulb 2. Such sliding of the bead 10 prevents excessive force from being exerted on the glass bulb 2.

The low softening point of the bead 10 made with hard glass makes it possible to seal the glass bulb 2 at a comparatively low temperature.

Consequently, adopting the structure of the practical example makes it possible to use the inexpensive hard glass and makes it very easy to manufacture a product therefrom.

The number and the shape of the vent conduits 22 formed in the bead 10 are not limited by the practical examples shown in FIGS. 3 and 5*a*–5*c*.

In addition, the practical example involves extending the common lead wire 9, but this arrangement is not the only option. It is also possible to extend the lead wire 5 of the high-beam filament 4 or the lead wire 7 of the low-beam filament 6.

Furthermore, the securing protrusion 12 shown in FIGS. 2 and 4*a* can be formed on the common lead wire 9 by pressure bending, or it can be formed by depositing a metal chip on the common lead wire 9.

Due to the structure described above, the present invention has the following merits.

First, the automotive lamp bulb is formed wherein the opening of the glass bulb is sealed at one end with the aid of the base, and at least one beam filament and at least two lead wires for supplying power to this beam filament are housed together inside this glass bulb. A distinctive feature is that one of the lead wires is extended, and the tip thereof is secured in the neck portion at the tip of the glass bulb with the aid of the bead of the present invention.

The bead makes it possible to shorten the protruding upper portion of the glass bulb. Because the bead is merely in linear contact with the inner surface of the neck portion, a vent conduit can be formed, thus allowing exhausting and gas filling steps to be performed at a high rate. The use of the bead makes it easier to align the lead wire with the neck portion. Because the bead is interposed, the lead wire is allowed to move in relation to the glass bulb, thus making it possible to use inexpensive hard glass.

Consequently, an inexpensive and compact lamp bulb can be easily manufactured.

The invention is also characterized by the fact that the protrusion for securing the bead is provided in the upper portion of the extended common lead wire.

The bead can be positioned on the lead wire with high precision, thus making manufacturing easier.

Furthermore, the invention is characterized by the fact that vent conduits are formed in the bead.

Large vent conduits can be secured, thus making it possible to perform exhausting and gas filling steps in a short time.

Moreover, the invention is characterized by the fact that the vent conduits are either depressions formed on the outer periphery of the bead or clearances formed between flat surfaces of the bead and the inner surface of the neck portion.

Any cost increase can be prevented because the depressions or clearances can be formed in a simple manner.

Additionally, another embodiment of the invention is characterized by the fact that its vent conduits are clearances formed between the outer periphery of the common lead wire and the inner periphery of the bead. Such clearances are, in fact, depressions formed on the inner periphery of the bead.

The invention being thus described, it will be understood that the embodiments may be varied in many ways. Such variations are not to be regarded as departures from the spirit and the scope of the invention. Instead, all such modifications are intended to be included within the scope of the claims.

We claim:

1. An automotive lamp bulb comprising:

a glass bulb having at one end a tip with a neck portion;

a base sealing an opposite end of the glass bulb;

at least one beam filament and at least two lead wires supplying power to the at least one beam filament being housed together inside the glass bulb;

an extended tip being positioned on one of the at least two lead wires; and a bead secured to said extended tip of one of the at least two lead wires, the bead aligning the extended tip of the one lead wire inside the neck portion of the glass bulb, whereby the extended tip of the one lead wire is allowed to move in relation to the neck portion of the glass bulb.

2. The automotive lamp bulb, according to claim 1, further comprising:

a protrusion provided near the extended tip of the one lead wire inside the neck portion of the glass bulb, the protrusion securing the bead near to the extended tip of the one lead wire.

3. The automotive lamp bulb, according to claim 1, further comprising:

at least one vent conduit formed through the bead means, the at least one vent conduit allowing gases to be exhausted from and filled into the glass bulb.

4. The automotive lamp bulb, according to claim 3, wherein said at least one vent conduit is a depression formed on an outer periphery of the bead.

5. The automotive lamp bulb, according to claim 3, wherein said at least one vent conduit includes a plurality of clearances formed between flat surfaces on an outer periphery of the bead and a curved inner surface on the neck portion of the glass bulb.

6. The automotive lamp bulb, according to claim 5, wherein said plurality of clearances are formed in thin, half-moon shapes.

7. The automotive lamp bulb, according to claim 3, wherein said at least one vent conduit includes a plurality of depressions formed on an inner periphery of the bead.

8. The automotive lamp bulb, according to claim 1, wherein said at least one beam filament includes a high-beam filament and a low-beam filament.

9. The automotive lamp bulb, according to claim 8, further comprising a shield connected to the low-beam filament, the shield blocking part of the light emitted by said low-beam filament.

10. The automotive lamp bulb, according to claim 1, further comprising a bridge housed inside the glass bulb, the bridge securing the at least two lead wires together.

11. The automotive lamp bulb, according to claim 1, wherein said bead is made of a borosilicate hard glass with a low softening point.

12. The automotive lamp bulb, according to claim 1, wherein said glass bulb is made of a quartz glass with a high softening point.

13. The automotive lamp bulb, according to claim 1, wherein said glass bulb is filled with halogen gas.

14. The automotive lamp bulb, according to claim 1, wherein said tip of the glass bulb has a projection height housing said bead and said extended tip of one of at least two lead wires.

15. The automotive lamp bulb, according to claim 1, wherein said extended tip of one of the at least two lead wires has a rectilinear portion.

* * * * *